US006175960B1

(12) United States Patent
Knittel

(10) Patent No.: US 6,175,960 B1
(45) Date of Patent: Jan. 23, 2001

(54) WEARER-ACTIVATED APPAREL HIDDEN DISPLAY

(76) Inventor: Robert Edward Knittel, 6160 37th St., Vero Beach, FL (US) 32966

( * ) Notice: Under 35 U.S.C. 154(b), the term of this patent shall be extended for 0 days.

(21) Appl. No.: 09/307,945

(22) Filed: May 10, 1999

(51) Int. Cl.[7] ..... A41B 1/00
(52) U.S. Cl. ..... 2/115; 2/69; 40/586
(58) Field of Search ..... 2/227, 228, 238, 2/115, 102, 108, 93, 94, 691, 85, 80, 83, 79, 244, 247–251; 40/586; 383/4, 38, 40

(56) References Cited

U.S. PATENT DOCUMENTS

| | | | | |
|---|---|---|---|---|
| 257,350 | | 5/1882 | Lubin . | |
| 1,610,236 | | 12/1926 | Cooper . | |
| 3,381,307 | | 5/1968 | Shingler . | |
| 3,537,108 | | 11/1970 | Daniels . | |
| 3,931,688 | | 1/1976 | Owens . | |
| 4,650,219 | * | 3/1987 | Sigman | 283/70 |
| 4,710,981 | | 12/1987 | Sanchez . | |
| 4,875,237 | * | 10/1989 | Cohen | 2/94 |
| 4,924,613 | * | 5/1990 | Levin | 40/586 |
| 4,991,233 | | 2/1991 | Hall . | |
| 5,086,516 | * | 2/1992 | Baxter et al. | 2/108 |
| 5,175,888 | | 1/1993 | Clark . | |
| 5,361,523 | | 11/1994 | Robinson . | |
| 5,379,461 | | 1/1995 | Wilmers . | |
| 5,742,940 | * | 4/1998 | Sparks | 2/79 |
| 5,794,267 | | 8/1998 | Wallace . | |
| 5,943,698 | * | 8/1999 | Blanks, I | 2/69 |
| 5,960,476 | * | 10/1999 | Danzy | 2/115 |
| 6,044,492 | * | 4/2000 | Krogh | 2/115 |

OTHER PUBLICATIONS

The Disney Catalog, 1998, pp. 9, 55, 58, PO Box 29144, Shawnee Mission, Kansas 66201–9144.

* cited by examiner

*Primary Examiner*—Gloria M. Hale

(57) ABSTRACT

An article of apparel including at least one predetermined segment which is capable of being opened furtively along at least a portion of its width by mechanical manipulation of a rigidifying material herein termed a stay (24). The stay (24) preferably comprises a pliable material. The stay (24) is affixed to the upper portion of the opening segment, which upper portion remains relatively static when the fabric is tensioned from a lower, middle or upper portion of the fabric whereby a display is revealed. The display may be on an insert (26) attached to the upper and lower edges of the opening segment and may also be provided without the insert (26) by an undershirt (40) in juxtaposition to the opening segment. A display may also be revealed on the epidermis of the wearer by the above mechanical manipulation.

17 Claims, 7 Drawing Sheets

WEARER-ACTIVATED APPAREL HIDDEN DISPLAY

CROSS REFERENCE TO RELATED APPLICATIONS

Not applicable.

STATEMENT REGARDING FEDERALLY SPONSORED RESEARCH

Not applicable.

REFERENCE TO MICROFICHE APPENDIX

Not applicable.

BACKGROUND

1. Field of Invention

The present invention relates to displays in apparel, specifically to improvements in the display revealing portions of apparel hidden displays.

The present invention further relates to methods of construction for hidden displays in apparel.

The present invention further relates to methods of wearer-activated revelation of hidden displays in apparel.

It is therefore an object of the present invention to provide an improved display revealing portion for apparel.

2. Description of Prior Art

A typical apparel display exhibits displays in a static state. The wearer shows a display to all who view it and lacks selective display control. Such displays consist of words alone or words and graphics intended to convey a message, image or combination of both. The message that the wearer wishes to convey in this type of apparel display is limited by the static nature of the display and its inability to target only specific individuals for viewing the display. Hidden displays provide the wearer with more audience selectivity for the display. Hidden displays are presently two-dimensional, visually obvious, clumsy to operate, and are labor intensive to manufacture. Apparel manufacturers are now interested in creating garments incorporating hidden displays.

A pocket construction in U.S. Pat. No. 257,350 issued to D. Lubin on May 2, 1882 is represented as a safety pocket and has no display purpose. It is awkward to operate and requires many components for manufacture.

Earlier apparel displays are limited to objects affixed to the outer part of a garment such as those disclosed in U.S. Pat. No. 1,610,263, issued to M. Cooper on Dec. 14, 1926 wherein no hidden image is mechanically displayed.

A hidden display component of a garment is presented in U.S. Pat. No. 3,381,307 issued to Donald K. Shingler on May 7, 1968 using inverted open pockets. It requires an obvious, overt action to activate the two-dimensional display thus preempting the element of surprise.

A pocket construction similar to Shingler's method presented in U.S. Pat. No. 3,537,108 issued to Richard W. Daniels on Nov. 3, 1970 for use as a safety pocket has no display properties and limited accessibility of the pocket for display purposes as well as the disadvantages cited above for Shingler's patent.

U.S. Pat. No. 3,931,688 issued to John C. Owens, Jan. 13, 1976 provides for a combination identification and storage display case for indicia. It uses flaps and panels to achieve the objectives as does Shingler's. This obvious display is two-dimensional.

U.S. Pat. No. 4,710,981 issued to David J. Sanchez on Dec. 8, 1987, for apparel hidden display using a flap pocket with a releasable gripping surface, requires obvious, overt action to activate the display. It uses the hook and loop method of opening the display for viewing with the accompanying deficiencies noted in U.S. Pat. No. 5,794,267 issued to Richard D. Walace on Aug. 18, 1998 which uses a series of exterior panels and flaps. This somewhat hidden apparel display requires an obvious, overt action to open the two-dimensional display as does the Shingler method. Wallace uses the hook and loop fastener method to open the display which, as he says, requires considerable force. This opening force can distort some fabrics thus negating the effect of the display. In addition, revealing the display by the hook and loop method of fastening creates a diverting sound. Manufacture of the device is complicated and labor intensive.

U.S. Pat. No. 4,991,233 issued to Andrew Hall on Feb. 12, 1991 creates a hidden display by use of a lanyard which is operated by another person. The display, featuring a sentence or phrase completion sequence, is obvious and requests a second person to operate it. A flap, which must be fastened and unfastened, is used for opening. The display is two-dimensional.

U.S. Pat. No. 5,175,888 issued to Howard E. Clark , Jan. 5, 1993 provides for a multiplicity of fabric strands creating a frayed effect through which displays may be partially revealed by wetting the fabrics. Given this limitation it appears that the garment so created is intended for some type of water sport. The positioning of the fabric strands precludes a full view of the display which is two-dimensional. Manufacture would be labor intensive.

U.S. Pat. No. 5,361,523 issued to Elizabeth M. Robinson, Nov. 8, 1994 declares a garment with a display, but only when the garment is fully opened. The opening mechanism is designed for a front, vertical opening garment. There is only one mode of opening the two-dimensional display and that is by parting the garment vertically.

U.S. Pat. No. 5,379,461 issued to Rita B. Wilmers on Jan. 10, 1995 uses the hook and loop exterior device to reveal the display as does the inventions of Wallace and Sanchez cited above with the same disadvantages. The object of the invention is to cover the display and to use the cover as a pocket.

A recent Disney catalog (The Disney Catalog, pp. 9, 55 and 58, 1998, P.O. Box 29144, Shawnee Mission, Kans. 66201-9144) attempts to simulate a hidden display. There is no revelation of a display in this apparel. The display relies on using a partial image over a pocket, or front and back images showing an animal head and tail respectively. It is apparent that a surprise effect is intended. The ad copy reads in part, " . . . cotton tees feature all-new 'peek' art work on the front. Turn around and surprise! There's adorable 'backward' peek art work on the back." (p. 9) It is doubtful that such apparel would surprise as the method has been in common use for some time.

It is evident that a search is underway by apparel manufacturers to create design effects which communicate, surprise and excite. It would be desirable to provide a hidden display for apparel in which the mechanism for operation is not obvious to the viewer, and in which the wearer can selectively and furtively control the visibility of the display, thereby enabling the wearer to choose the audience for the hidden display, activate it and startle viewers with elements of surprise and excitement.

OBJECTS AND ADVANTAGES

The present wearer-activated apparel hidden display provides such a hidden display. It is, therefore, an object of the invention to provide in a piece of apparel a hidden display which is not obvious to the viewer, and in which the wearer can selectively control the viewing of the hidden display through motion initiated by the wearer, such motion being remote, in varying degrees, from the hidden display.

In addition to the objects and advantages described above, several objects and advantages of the wearer-activated apparel hidden display are:

(a) to provide a display which incorporates the elements of surprise and excitement.

(b) to introduce surprise motion to the outward disclosure of the hidden display.

(c) to provide the wearer with a method of communicating individually with another through the use of apparel hidden displays.

(d) to provide a third dimension to the apparel's hidden display.

(e) to provide a combination of an exterior display and an interior hidden display which may be combined for display at the same time.

(f) to provide for an exterior word message display combined with a hidden graphic display which relates to the word message when the hidden display is revealed.

(g) to provide for an exterior graphic display combined with a hidden word message display which relates to the graphic display when the hidden display is revealed.

(h) to provide a hidden, visual, official identification which may be revealed at the wearer's option.

(i) to provide a wide variety of display possibilities for wearer-activated apparel hidden displays.

(j) to provide a mechanism for wearer-activated apparel hidden displays which can be used for a wide variety of apparel.

(k) to provide a simple, unobtrusive mechanism to accomplish the above objects.

(l) to provide wearer-activated apparel hidden displays which are simple to use.

(m) to provide the wearer multiple choices for activating the display.

(n) to provide the wearer multiple choices of displays through the use of detachable and thus changeable displays.

(o) to provide a wearer-activated apparel hidden display which is easy to manufacture, requiring no further manufacturing skills, materials and equipment than those currently used in the garment trade.

Some of the advantages of my wearer-activated apparel hidden display are referred to in the above list of objects. These include three-dimensional hidden displays, ease of operation, multiple methods of operation, activation of displays which provokes surprise and excitement, clandestine use of displays, changeable displays and ease of manufacture. Further objects and advantages of my invention will become apparent from a consideration of the drawings and ensuing description.

LIST OF REFERENCE NUMERALS

20 shirt

22 slit

24 stay

26 insert

28 insert display

30 undershirt display

32 stay ends

34 stitching

36 insert fold

38 shirt fabric

40 undershirt

42 loop surface of fastener
44 hook surface of fastener
46 indicia

SUMMARY

In accordance with the present invention a wearer-activated apparel hidden display comprises an article of apparel having a segment capable of being opened and a mechanism for furtively opening the segment thus making visible a hidden display.

DETAILED DESCRIPTION OF INVENTION

Figure 3:
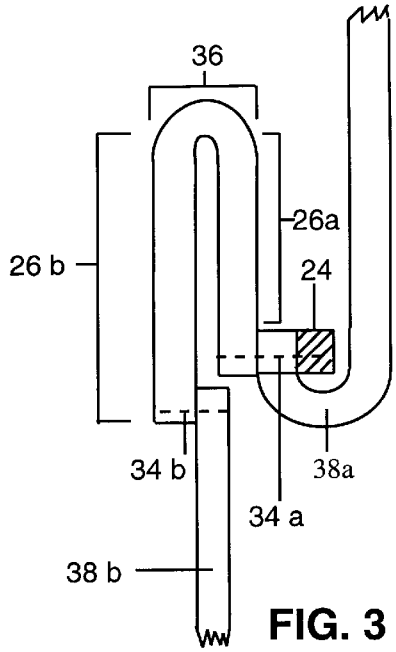
FIG. 3 is an enlarged cross-sectional view of the display activation mechanism shown in FIG. 1 taken along section line 3—3.
Figure 4:
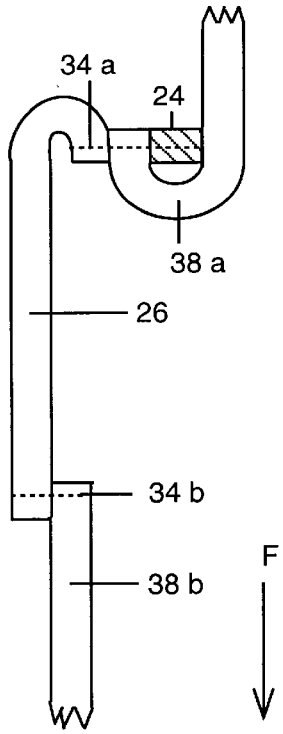
FIG. 4 is an enlarged cross-sectional view of the display activation mechanism shown in FIG. 12 taken along section line 4—4.

A preferred embodiment of the wearer-activated apparel hidden display of the present invention is illustrated in FIGS. I through 20. FIG. I shows a shirt 20 of the pullover type, commonly known as a sweatshirt, with a slit 22 at the upper and lower interior edges of which is attached a piece of cloth, herein termed an insert 26 (shown in more detail in FIG. 9), to which a display may be affixed. Insert 26 is folded in half, hidden inside shirt 20. A rigidifying material herein termed a stay 24, the same width as slit 22, is attached to the upper, inner edge of slit 22. FIG. 3 is a cross-sectional view of insert 26 in the closed position and stay 24, taken along section line 3—3 of FIG. 1. Insert 26 folds at insert fold 36 creating an upper portion of insert 26*a* and lower portion of insert 26*b*. FIG. 3 shows stay 24 attached to shirt fabric 38*a* and insert 26*a* by stitching 34*a*. Insert 26*b* is attached to shirt fabric 38*b* by stitching 34*b*. FIG. 4 is a cross-sectional view of insert 26 (26*a* and 26*b* in FIG. 3) in the open viewing position taken along section line 4—4 of FIG. 12. View is from the right side of the page.

Figure 2:
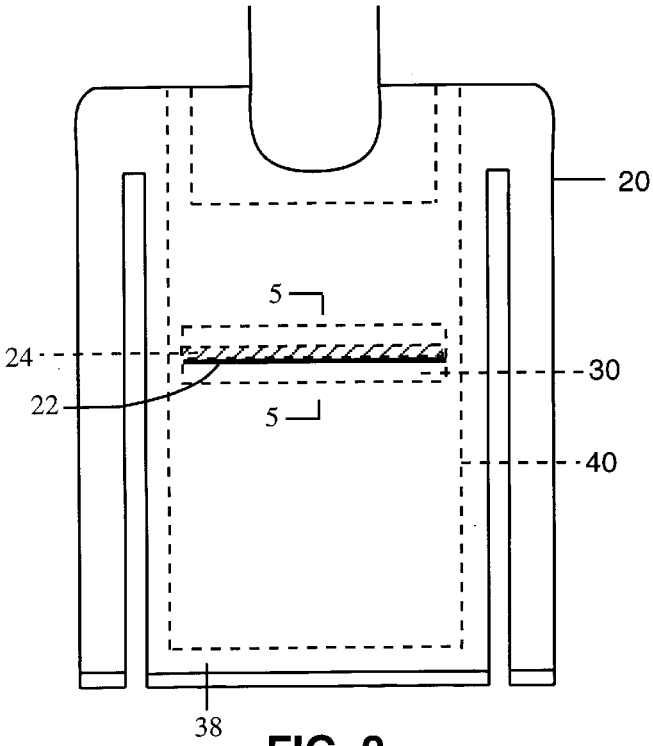
FIG. 2 is a perspective view of shirt front prior to display activation using an undershirt.
Figure 5:
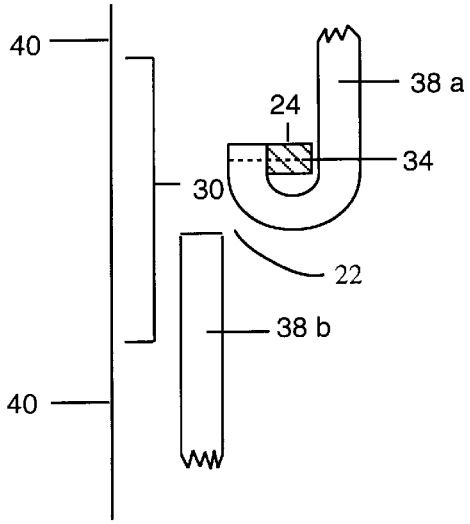
FIG. 5 is a cross-sectional view of the display activation mechanism shown in FIG. 2 taken along section line 5—5.
Figure 6:
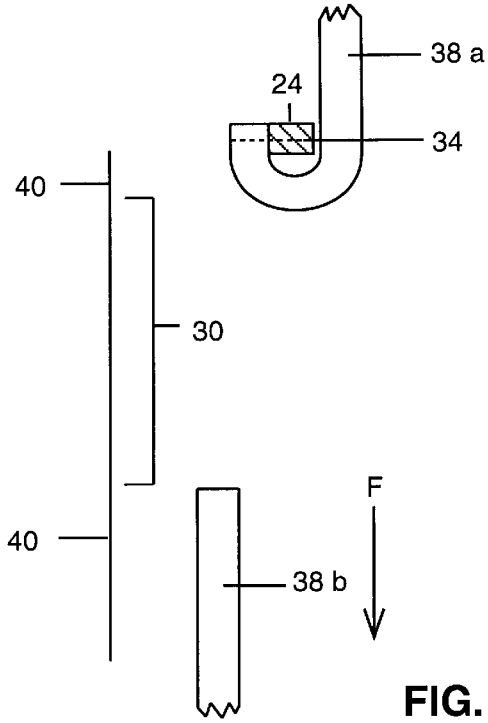
FIG. 6 is a cross-sectional view of the display activation mechanism shown in FIG. 13 taken along section line 6—6.

FIG. 2 is a perspective view of shirt 20 with stay 24, the same width as slit 22, attached to the upper, inner edge of slit 22 without insert 26 but with an undershirt 40 bearing a display 30 which is hidden beneath shirt 20 with slit 22 for opening. FIG. 5 is a cross sectional view of shirt 20 taken along section line 5—5 of FIG. 2 in the closed position without insert 26, for use with display 30 affixed to undershirt 40. Stay 24 is attached to the upper interior surface of shirt fabric 38*a* by stitching 34. The lower portion of shirt fabric 38*b* rests in juxtaposition to shirt fabric 38*a* at slit 22. FIG. 6 is a cross-sectional view of shirt 20, taken along section line 6—6 of FIG. 13. Shirt fabric 38*a* and 38*b* are in the open position, revealing display 30.

Figure 7:
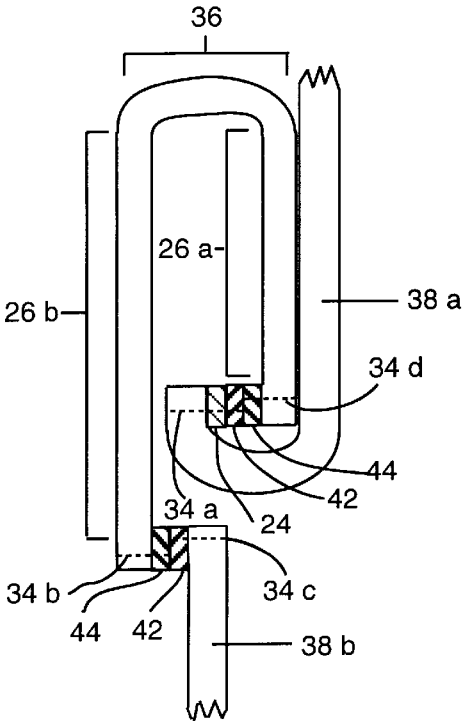
FIG. 7 is a cross-sectional view of the display activation mechanism shown in FIG. 1 taken along section line 3—3 using the hook and loop method of attaching the insert.
Figure 8:
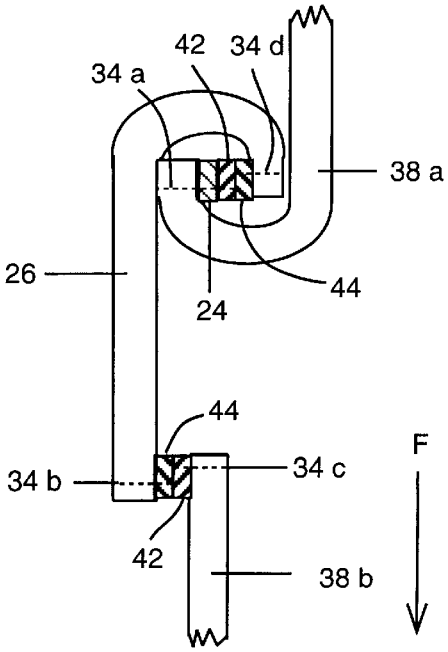
FIG. 8 is a cross-sectional view of the display activation mechanism shown in FIG. 12 taken along section line 4—4 using the hook and loop method of attaching the insert.

FIGS. 7 and 8 are cross-sectional views showing the positioning of a hook surface of fastener 44 (shown in FIG. 10), and a loop surface of fastener 42 (shown in FIG. 11) for use with a detachable insert.

FIG. 7 shows the hook surface of fastener 44 attached to the upper exterior surface of insert 26*a* by stitching 34*d* and hook surface of fastener 44 attached to the lower exterior surface of insert 26*b* by stitching 34*b*. The loop surface of fastener 42 is attached to stay 24 and to the interior surface of the upper portion of shirt fabric 38*a* by stitching 34*a*, and loop surface of fastener 42 is attached to the interior surface of the lower portion of shirt fabric 38*b* by stitching 34*c*.

FIG. 8 is a cross-sectional view of insert 26 (26*a* and 26*b* in FIG. 7) in the open viewing position. The view is from the right side of the page.

Figure 12:
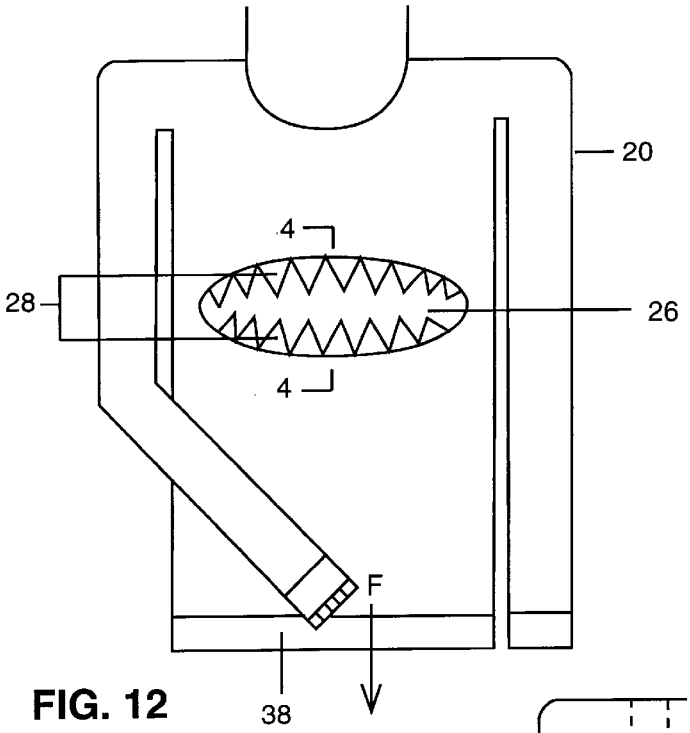
FIG. 12 is a perspective view of shirt front with display revealed on insert by downward tug on front of shirt fabric.
Figure 13:
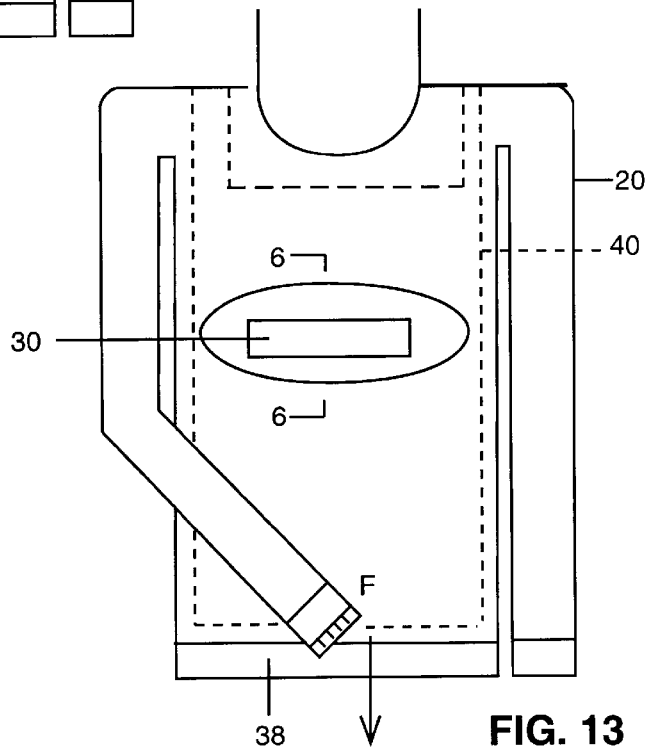
FIG. 13 is a perspective view of shirt front with display revealed on undershirt by a downward tug on the front of shirt fabric.
Figure 14:
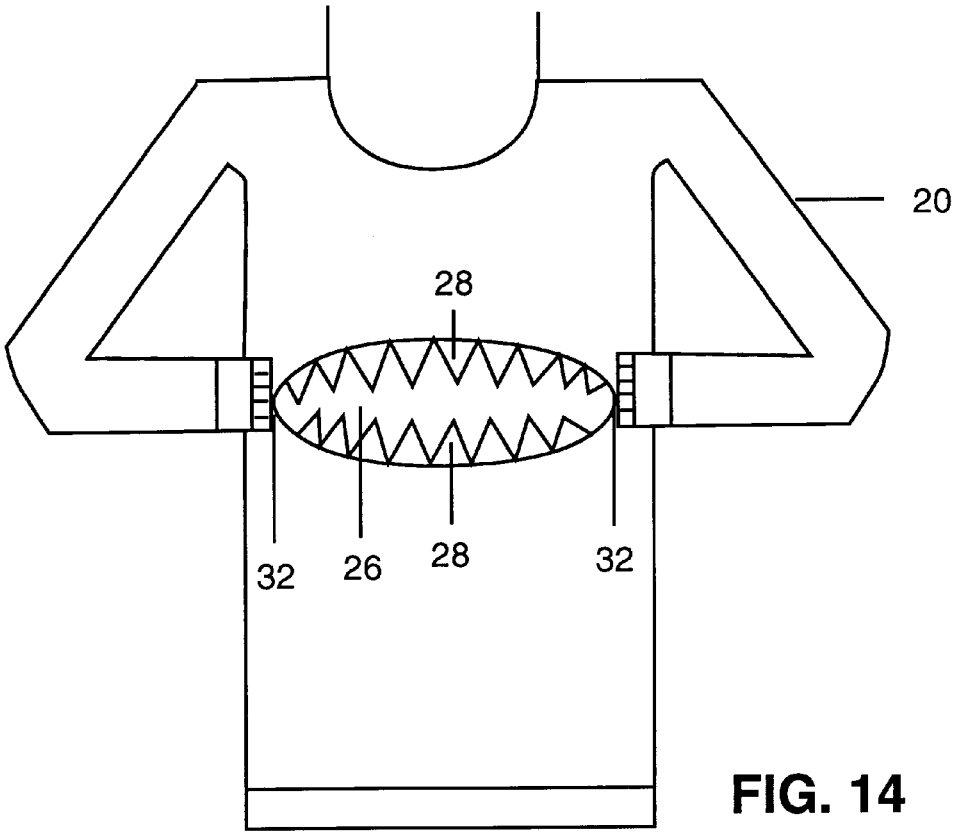
FIG. 14 is a perspective view of shirt front with display revealed on insert when wearer applies pressure at stay ends of concealed stay.
Figure 15:
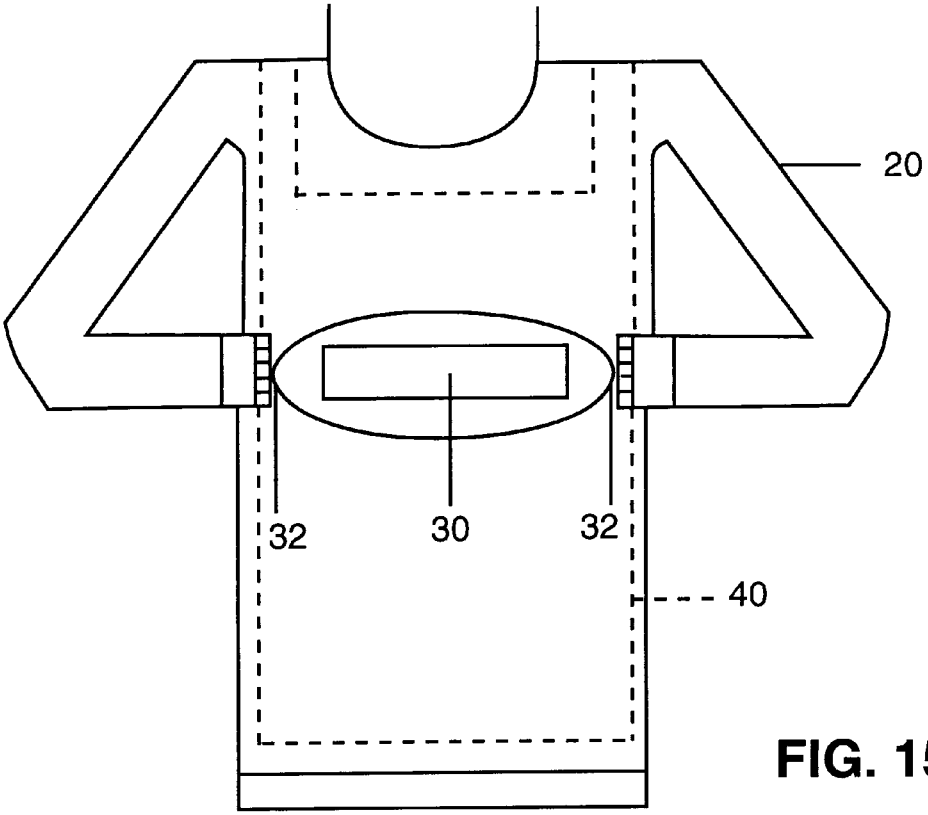
FIG. 15 is a perspective view of shirt front with display revealed on undershirt when wearer applies pressure at stay ends of concealed stay.
Figure 16:
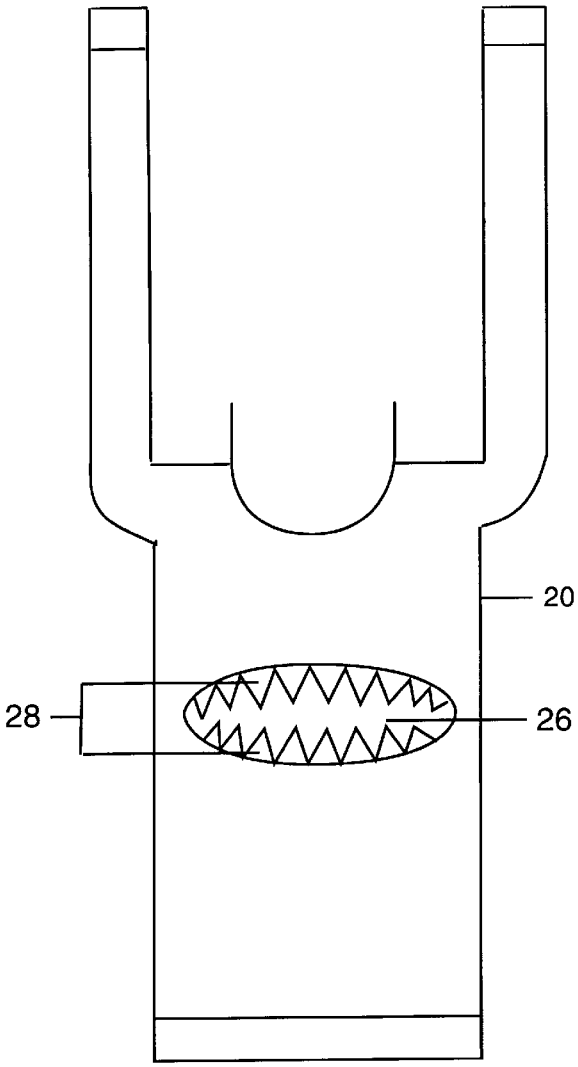
FIG. 16 is a perspective view of shirt front with display revealed on insert when wearer raises arms overhead.
Figure 17:
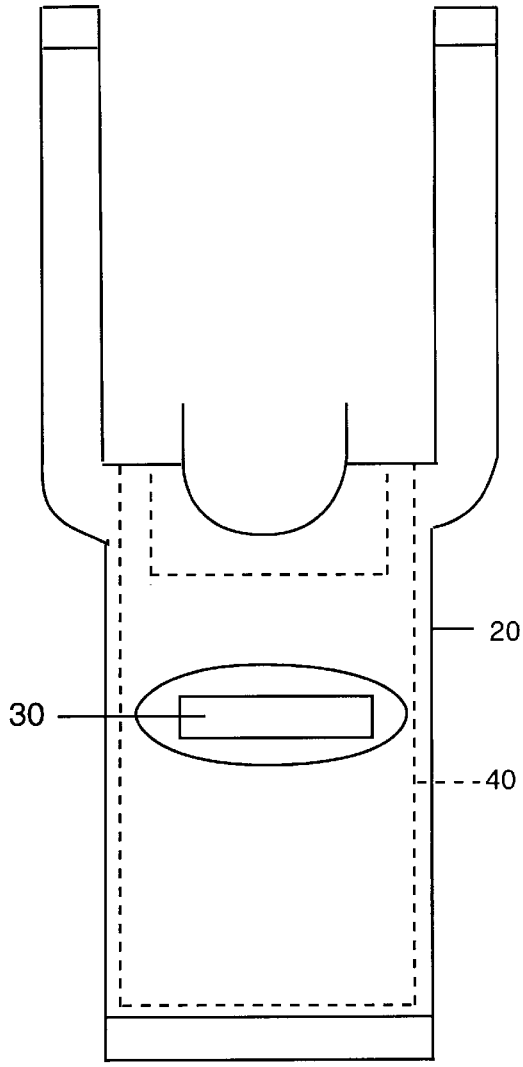
FIG. 17 is a perspective view of shirt front with display revealed on undershirt when wearer raises arms over head.

FIGS. 12 through 17 illustrate the effects of several operations of the hidden display mechanism. FIGS. 12, 14, 16 show the operation of the display revealing mechanism with the use of an insert. FIGS. 13, 15, 17 show the operation of the display revealing mechanism without an insert, using an undershirt containing a display. It can also be used for a body display such as a tattoo, transfer and other epidermal displays.

FIG. 12 shows shirt 20 with display 28 affixed to insert 26 revealed by a downward tug on the lower portion of shirt fabric 38 which creates opening force F. FIG. 13 shows shirt 20 with display 30 on undershirt 40 revealed by a downward tug on the lower portion of shirt fabric 38 which creates opening force F.

FIG. 14 shows shirt 20 with display 28 affixed to insert 26 revealed by pressure on concealed stay ends 32 of stay 24 (not shown here but shown in FIGS. 3 and 4.) FIG. 15 shows shirt 20 with display 30 affixed to undershirt 40 revealed by pressure on concealed stay ends 32 of stay 24 (not shown here but shown in FIGS. 5 and 6.) FIG. 16 shows shirt 20 with display 28 on insert 26 revealed by thrusting arms overhead. FIG. 17 shows shirt 20 with display 30 affixed to undershirt 40 revealed by thrusting arms overhead.

Figure 18:
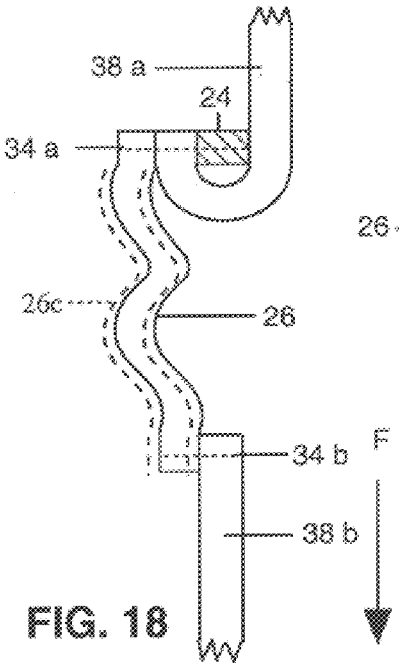
FIG. 18 is the same as FIG. 4, an enlarged cross-sectional view of the display activation mechanism shown in FIG. 12 taken along section line 4—4, with the exception that the insert is shown in a wrinkled mode with movement provided by the wearer.
Figure 19:
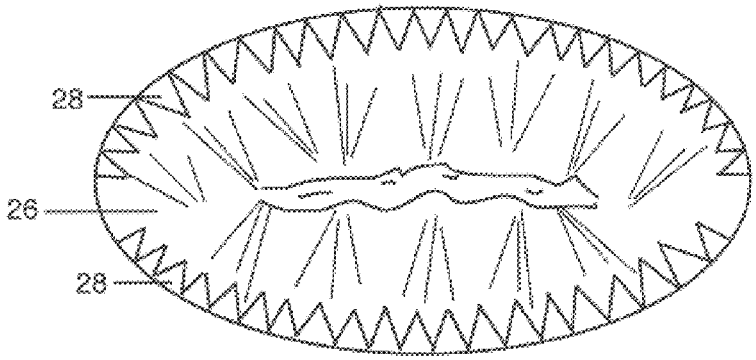
FIG. 19 is a frontal perspective drawing of the insert open in the wrinkled mode for a 3-D effect.
Figure 20:
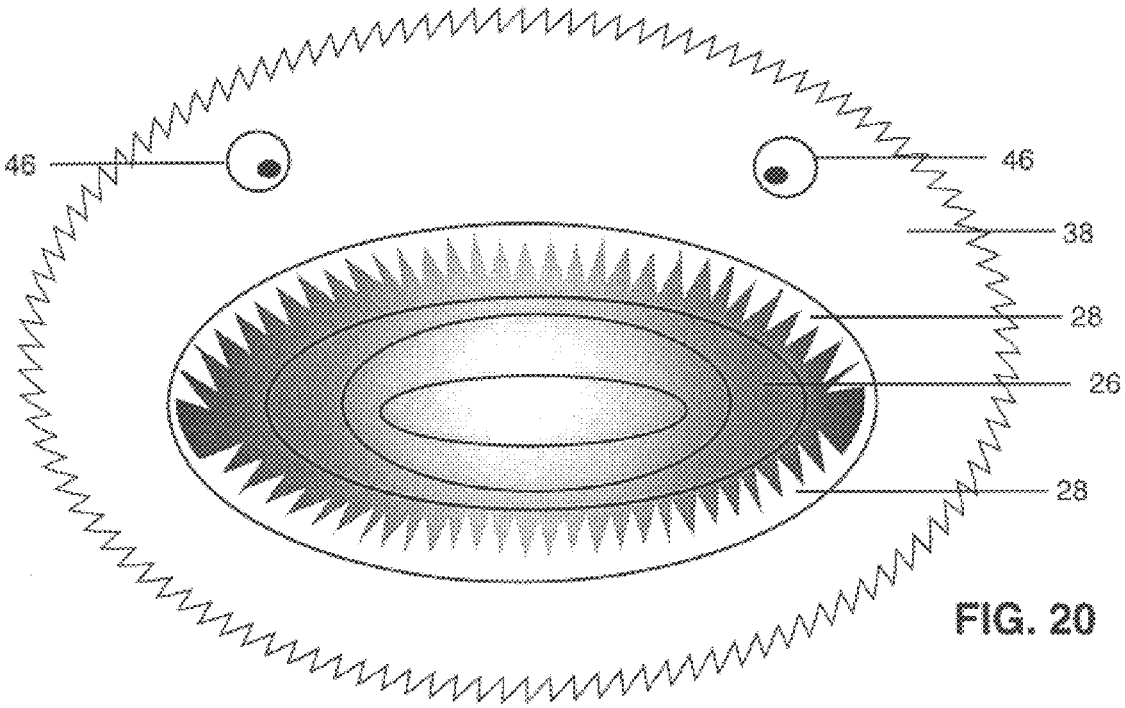
FIG. 20 is a frontal perspective drawing of the insert open in the wrinkled mode with external indicia on the shirt relating to the insert, forming a startling 3-D effect.

FIG. 18 is the same as FIG. 4, an enlarged cross-sectional view of the display opening mechanism shown in FIG. 12 taken along section line 4—4, with the exception that insert 26 is shown in a wrinkled mode with insert 26*c* movement provided by the wearer. FIG. 19 is a frontal perspective drawing of the insert open in the wrinkled mode for a 3-D effect. FIG. 20 is a frontal perspective drawing of insert 26 open in the wrinkled mode with external indicia 46 on shirt fabric 38 relating to opened insert 26 with affixed insert display 28, forming a startling 3-D effect.

MATERIALS OF CONSTRUCTION

The Rigidifying Material

The term "rigid," for the purpose of this invention, is a relative term. It means that the rigidifying material will provide a desired amount of rigidity to the apparel material and the inserted material to which it is attached. That is, it is relatively rigid when compared to the rigidity of the material to which it is attached. A pliable, rigidifying material was used to effect the operations shown in this application. Materials such as poly propylene, belt webbing, elastic, and other rigidifying materials common to the trade have all been used as rigidifying components in exemplary models of the present invention. The decision to use a more rigid material over a less rigid material depends on the weight and rigidity of the materials to which it is attached. In the preferred embodiment of the present invention as presented above, the rigidifying material is a plastic stay made of cotton covered poly propylene commonly used for hem stiffening. The plastic stay is 0.625 cm. (¼ inch) wide and 0.15625 cm. (1/16 inch) thick, sewn into the center of a cotton cover 1.25 cm. (½ inch) wide, forming a tube around the plastic providing a 0.03125 cm. (⅛ inch) sewing edge on each side of the cotton tube. This was obtained from the Dritz Corporation, Spartanburg, S.C. 29304.

The Apparel

The apparel used in the model of the preferred embodiment of the invention is a 50% cotton, 50% polyester fiber sweatshirt. This combination of cloth fibers is commonly used in the trade. Other types of shirts, garments and accessories may be used.

The Insert

The insert used to carry the imprinted design is a cotton cloth rectangle. Other types of inserts may be used. The size of the insert may be chosen according to the message to be conveyed. An insert display producing a three-dimensional effect suitable, for example, for an animal's mouth may be obtained by using a longer insert. A flattened display surface suitable for displaying reading material may be obtained by using a shorter insert. The insert may be detachable, as with hook and loop closures, and thus interchangeable with other inserts. The garment can be provided with a loop closure so that it can be used with an insert which is provided with a hook closure. It can thus also be used without an insert with an undershirt display or the wearer's epidermis display, such as a tattoo or transfer.

Method of Manufacturing the Wearer-Activated Apparel Hidden Display

There are a number of processes that can be used to manufacture wearer-activated apparel hidden displays. While not intended to be all inclusive, several processes are identified. The variation of processes depends on the materials used. These include sewing, hook and loop, adhesive bonding, a combination of metal and fabric bonding or sewing, a combination of plastic and fabric bonding or sewing, a combination of rubber and fabric bonding, a combination of rubber and plastic bonding. Each of these processes can be done in a variety of ways known to the trade.

An advantage to the hook and loop method of fastening the insert to the shirt may be obtained by attaching the loop section of the hook and loop fastener to the underside of the shirt at the upper and lower edges of the slit. The hook section of the fastener is attached only to the upper and lower edges of the display side of the insert. In this way the shirt may be used not only with the detachable inserts but also without the inserts as the loop section of the fastener will not interfere with the operation of the shirt mechanism through possible attachment of the fastener to an undershirt or other material as a hook fastener might.

A particularly desirable feature of the wearer-activated apparel hidden display is that it does not use hook and loop fasteners nor any other type of fastener in the opening and closing of the display revealing mechanism. The only use of a hook and loop type fastener is for the optional changing of inserts and their affixed displays.

Optional Material

The article of apparel can be fashioned from fabric or plastic. The insert can be made from fabric or plastic. The rigidifying material can be made from fabric, plastic, elastomeric material, wood, or metal. The preferred embodiment of the invention uses any pliable material of proper tensile strength for the material to which it is to be attached. Costumes of various types may be made from any combination of materials; accessories may utilize other materials not mentioned above. Materials can be sewn or bonded with adhesives, both hot and cold.

The preferred embodiment of the wearer-activated apparel hidden display provides a wearer-activated display for apparel which is easy to manufacture, requiring no further manufacturing skills, materials and equipment than those currently employed in the garment trade. All of the components of the preferred embodiment can be sewn together with present garment trade machinery. Insert and shirt designs can be printed economically with commonly used processes such as silk screening and computer generated transfers. Wearers can make and use designs of their own choosing.

Possible Uses for the Wearer-Activated Apparel Hidden Display

Wearer-activated apparel hidden displays of the present invention can be used in many articles of apparel and accessories where a display is desired. The list below is exemplary but not exhaustive.

On shirts and trousers to startle selected viewers.

On shirts and trousers to give a silent message to persons approaching or following the wearer, or to a group gathered near the wearer.

On shirts and trousers to answer unwanted questions or comments with a silent reply such as "I don't know."; "I know it."; I don't care." and other phrases.

On handbags and other commonly carried containers for open or surreptitious communication.

On gloves for the above mentioned purposes.

On ties to change designs and for any of the above mentioned purposes.

On hats for the above mentioned purposes.

On shoes, particularly the toes of shoes, to give a secret message or code.

On knapsacks and school bags for any of the above mentioned purposes.

On babies' and children's clothing to answer frequently asked questions about the child. such as "It's a boy!" or "It's a girl!"

On pets' coats to answer frequently asked questions about the pet, and for any of the above mentioned purposes.

On garments to establish identities in covert operations where identities are secret but must be known to other members of the operation. A special method of accomplishing this is shown in Item 3 below, under "Ways of Activating the Apparel Hidden Display."

Ways of Activating the Apparel Hidden Display

There are various ways to operate the opening of the wearer-activated apparel hidden display of the present invention. While the following list is not intended to be exhaustive, it does set forth, for illustrative purposes, a variety of possible hidden display manipulation methods. All three of the following activation methods are accomplished with the single opening construction method described in this document.

1. Manipulation by the wearer's hand pulling downward on the apparel fabric attached to the insert thus parting the insert and revealing the display. This is shown in FIGS. 12 and 13 of the accompanying drawings and is the preferred embodiment of the invention.
2. Manipulation by the wearer using both hands to feign arms akimbo posture while applying pressure at both ends of the concealed stay thus revealing the display. This is shown in FIGS. 14 and 15 of the accompanying drawings and is the preferred embodiment of the invention.
3. Manipulation by the wearer using both arms thrust outstretched above the head thus parting the insert and revealing the display. This is shown in FIGS. 16 and 17 of the accompanying drawings and is the preferred embodiment of the invention. This manipulation method could be a crucial movement if a member of a covert operation were confronted by another member of the operation who did not know the identity of the person confronted. The person confronted could then respond to a command of surrender by thrusting hands in the air revealing the identity marker known only to members of the covert operation.

OPERATION - FIGS. 1 through 17

The operation of the wearer-activated apparel hidden display in the preferred embodiment of the invention is demonstrated using a pullover shirt, commonly known as a sweatshirt.

Figure 1:
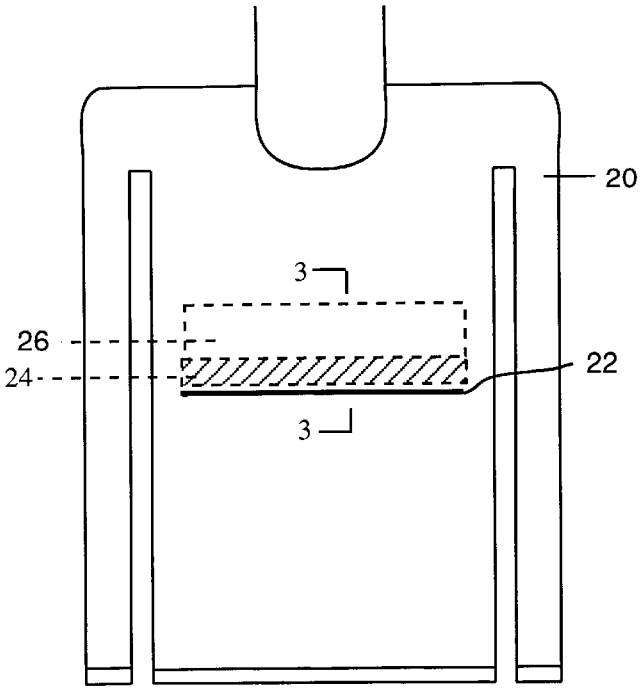
FIG. 1 is a perspective view of shirt front prior to display activation using an insert
Figure 9:
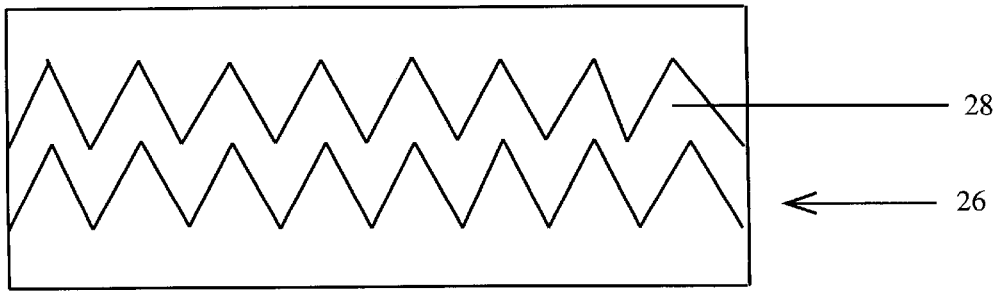
FIG. 9 is a perspective view of the insert containing a display ready to be attached to the shirt and stay.

FIGS. 1 and 2 of the accompanying drawings show the appearance of the shirt front before operating the display. FIG. 1 shows a shirt 20 with an outward appearing slit 22, an inner insert 26 and a rigidifying member herein termed a stay 24. FIG. 9 shows insert 26 containing insert display 28. FIG. 12 shows shirt 20 with a downward tug on the lower, front edge of shirt fabric 38 causing force F to tension shirt fabric 38 opening insert 26 revealing display 28. The downward tug causes shirt fabric 38 to open because of the relative rigidity of stay 24 (not shown here but shown in FIGS. 3, 4, 5, 6, 7, 8 of my above patent application). FIG. 3 shows an enlarged cross-sectional view of the mechanism of operation in the closed position taken along section line 3—3 of FIG. 1. Insert fold 36 holds insert 26*a* and 26*b* upward in the hidden position. The view is from the right side of the page. Stitching 34*a* attaches stay 24 to the upper interior surface of shirt fabric 38*a*. Stitching 34*a* also attaches the upper portion of insert 26*a* through its inner surface to the upper exterior surface of shirt fabric 38*a*. The lower interior surface of shirt fabric 38*b* is attached to the lower exterior surface of insert 26*b* by stitching 34*b*.

FIG. 4 shows an enlarged cross-sectional view of the mechanism of operation in the open position taken along section line 4—4 of FIG. 12. Insert 26 is revealed when a downward tug on the lower portion of shirt fabric 38*b* creates force F, which causes insert 26 (26*a* and 26*b* in FIG. 3) to unfold and is held open by the rigidity of stay 24.

Figure 10:
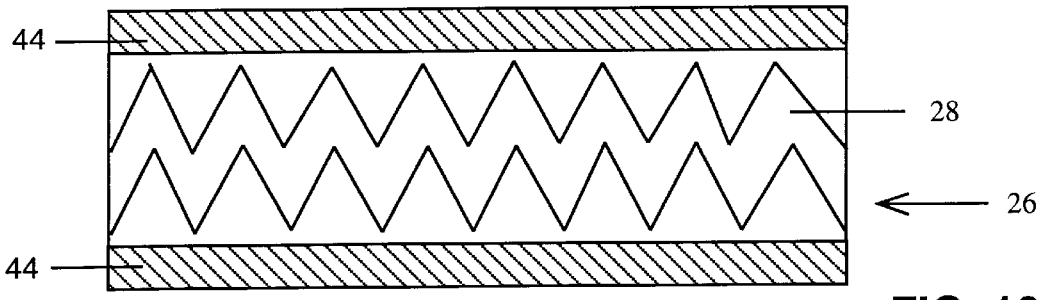
FIG. 10 is a perspective view of the insert containing a display with hook surface of fasteners attached to the upper and lower edges of display side of the insert.

Another embodiment of the invention uses hook and loop fasteners making it possible to employ interchangeable inserts. The outward appearance of the shirt is the same as in FIG. 1 and the operation is the same as shown in FIGS. 3 and 4. The construction is modified to accommodate the detachable insert as shown in FIGS. 7 and 8. FIG. 7 shows an enlarged cross-sectional view of the mechanism of operation in the closed position taken along section line 3—3 of FIG. 1. FIG. 10 shows the hook surface of fastener 44 attached to the upper and lower edges of insert 26 on which is affixed display 28. FIG. 7 shows hook surface of fastener 44 attached to the face of upper insert 26*a* by stitching 34*d* and to face of lower insert 26*b* by stitching 34*b* with fold 36 holding insert 26*a* and 26*b* in the hidden position. The view is from the right side of the page.

Figure 11:
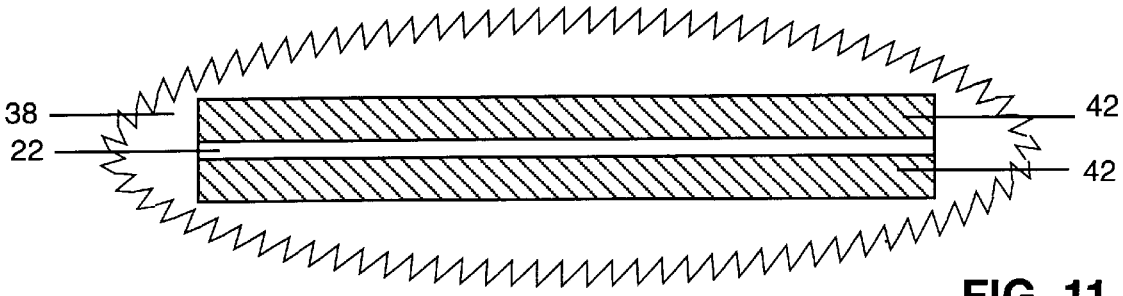
FIG. 11 is a perspective view of the loop surface of fastener attached to the reverse side of shirt fabric at the upper and lower edges of slit.

Loop surface of fastener 42 is attached to stay 24, both of which are attached to reverse side of shirt fabric 38*a* by stitching 34*a*. Loop surface of fastener 42 is attached to reverse side of shirt fabric 38*b* by stitching 34*c*. FIG. 11 shows loop side of fastener 42 attached to reverse side of shirt fabric 38 at the upper and lower edges of slit 22.

FIG. 8 shows an enlarged cross-sectional view of hook-and-loop insert 26 (26*a* and 26*b* in FIG. 7) in the open position. Its operation is the same as shown in FIG. 4. With the loop surface of the hook and loop fastener attached to the shirt fabric the shirt may be used alternately without the insert because the loop surface of the fastener will not attach itself to any fabric as the hook surface could. With this construction the shirt described could be used with multiple inserts or without the inserts by using an undershirt or other underlayer, including epidermis, upon which a display could be utilized.

FIGS. 2, 5, 6, 13, 15 and 17 demonstrate another embodiment of the wearer-activated apparel hidden display without an insert. In FIG. 2 the outward appearance of shirt 20 before opening the display is the same as that of FIG. 1 but without a hidden insert. In its place, an undershirt 40 with display 30 hidden behind slit 22 is used. FIGS. 5 and 6 show the opening mechanism without insert 26 for use with undershirt 40.

FIG. 5 is an enlarged cross-sectional view of the opening mechanism in the closed position taken along section line 5—5 of FIG. 2. Shirt fabric 38*a* and 38*b* are in the closed position separated by slit 22. Stay 24 is attached to the upper interior surface of shirt fabric 38*a* by stitching 34. Undershirt 40 is in juxtaposition to the aforementioned assembly.

FIG. 6 is an enlarged cross-sectional view of the opening mechanism in the open position taken along section line 6—6 of FIG. 13. Shirt fabric 38*a* and 38*b* are in the open position with lower portion of shirt fabric 38*b* pulled down by a tug, force F, away from the upper portion of shirt fabric 38*a* which is held in place by stay 24, attached to shirt fabric 38*a* by stitching 34, to reveal display 30 on undershirt 40. FIG. 13 shows shirt 20 with undershirt display 30 on undershirt 40 revealed by force F created by a downward tug on shirt fabric 38.

Alternate methods of operating the wearer-activated apparel hidden display are shown in FIGS. 14, 15, 16 and 17. In the arms akimbo method of operation, shown in FIGS. 14 and 15, pressure at concealed stay ends 32 of stay 24 (not shown here but shown in FIGS. 2, 5 and 6) causes the relative rigidity of stay 24 to force shirt fabric 38*a* (shown in FIGS. 3, 4, 5 and 6) to move upward revealing insert display 28 on insert 26 in FIG. 14 and undershirt display 30 on undershirt 40 in FIG. 15.

In the hands overhead method of operation shown in FIGS. 16 and 17, the upward movement of the arms causes the rigidity of stay 24 (shown in FIGS. 3, 4, 5 and 6) to carry shirt fabric 38*a* upward revealing insert display 28 on insert 26 in FIG. 16 and undershirt display 30 on undershirt 40 in FIG. 17.

The shirt may be prepared for a subsequent display in either of two ways. Employing the method of revealing insert 26 as shown in FIGS. 14 and 15, which is accomplished by pressing stay 24 at stay ends 32, the shirt will return to its outward appearance by pulling the ends of the stay 24 outward thus hiding insert 26 as shown in FIGS. 1 and 2. If one is revealing the display by the methods shown in FIGS. 12, 13, 16 and 17, the wearer need only tuck insert 26 upward inside the shirt 20 so that the only outward appearance is slit 22 as shown in FIGS. 1 and 2. Insert 26 may also be folded downward in the hidden position. However, the upward fold is the preferred embodiment of my wearer-activated apparel hidden display.

FIG. 18 is the same as FIG. 4 except a longer insert 26 is used creating a wrinkled effect which gives a third dimension to the display. The dashed line 26*c* represents movement of opened insert 26 which can be manipulated by the wearer using his or her stomach muscles in a manner similar to the movements of a belly dancer. This effect is particularly startling and amusing.

FIG. 19 is a frontal perspective drawing of this wrinkled effect which gives a depth dimension to insert display 28 on insert 26. FIG. 20 is a frontal perspective drawing of insert 26 open in the wrinkled mode with external indicia 46 on shirt fabric 38 relating to insert 26 with affixed insert display 28, forming a startling 3-D effect.

Other patterns of sewing insert 26 may be used to create various dimensional effects for display of the insert, such as greater or lesser display of the insert surface or manipulation of the insert into various configuration by pleating, shirring and other similar methods.

CONCLUSION, RAMIFICATIONS, AND SCOPE

Thus, the reader will see that the wearer-activated apparel hidden display of this invention can be used in numerous ways to establish and maintain selective communication through the use of hidden displays in apparel, employing an element of surprise to attract the attention of selected individuals or groups. The surprise element includes a perception of depth as seen by the viewer, giving a three-dimensional effect to the communication which can be by both words and graphics. The simple, unobtrusive mechanism of the invention enables a wearer to use it to display hidden identification as well, in a choice of several non-threatening movements. Through the use of changeable displays and a choice of methods of display, the user can have multiple communication uses for the same piece of apparel.

While my above description contains many specificities, these should not be construed as limitations on the scope of the invention, but rather as an exemplification of one preferred embodiment thereof. Many other variations are possible. For example, the mechanism could be activated by a pull tab attached to a cord. The insert could be provided with a simple thrusting force to project it outward toward the viewer thus enhancing the three-dimensional effect. The opening mechanism could be placed in other positions, vertical as well as horizontal, for different effects. The mechanism could be adapted for use on accessories as well as apparel. More than one mechanism could be used on the same piece of apparel.

Thus the scope of the invention should be determined by the appended claims and their legal equivalents, rather than by the examples given.

While particular embodiments of the present invention have been illustrated and described, it will be obvious to those skilled in the art that various changes and modifications can be made without departing from the spirit and scope of the invention, and it is intended to cover in the appended claims all such modifications that are within the scope of this invention.

I claim:

1. An article of apparel providing a hidden display comprising:

a) an article of apparel including at least one predetermined segment which is capable of being opened furtively along at least a portion of its width by mechanical manipulation of a predetermined portion thereof and b) said predetermined mechanically manipulatable portion of said segment comprising a rigidifying means including a stay and c) a display means including an insert affixed to said segment by which means the furtive opening of said segment reveals said hidden display.

2. The article of claim 1, wherein said rigidifying means includes a member of pliable material.

3. The article of claim 2, wherein said pliable member comprises a plastic material.

4. The article of claim 3, wherein said plastic material is poly propylene.

5. The article of claim 3, wherein said plastic material is enclosed in fabric.

6. The article of claim 1, wherein said insert is affixed with releasable fasteners.

7. The article of claim 6 wherein said releasable fasteners are made of hooks and loops.

8. An article of apparel providing a hidden display comprising:

a) an article of apparel including at least one predetermined segment which is capable of being opened furtively along at least a portion of its width by mechanical manipulation of a predetermined portion thereof and b) said predetermined mechanically manipulatable portion of said segment comprising a rigidifying means including a stay and c) a display means comprising an article of apparel to which a display is affixed, said display being so positioned on article of apparel so as to be substantially in juxtaposition to said segment when worn under said article of apparel by which means the furtive opening of said segment reveals said hidden display.

9. The article of claim 8, wherein the rigidifying material includes a member of pliable material.

10. The article of claim 9, wherein said pliable member comprises a plastic material.

11. The article of claim 10, wherein said plastic material is poly propylene.

12. The article of claim 10, wherein said plastic material is enclosed in fabric.

13. The article of claim 8, wherein the loop side of a hook and loop fastener is attached for possible alternate use with an insert having the hook side of a hook and loop fastener attached.

14. An article of apparel providing a hidden display comprising:

a) an article of apparel including at least one predetermined segment which is capable of being opened furtively along at least a portion of its width by mechanical manipulation of a predetermined portion thereof and b) said predetermined mechanically manipulatable portion of said segment comprising a rigidifying means including a stay and c) a display means by which means the furtive opening of said segment reveals said hidden display.

15. The article of claim 14, wherein the rigidifying means includes a member of pliable material.

16. The article of claim 15, wherein said pliable member comprises a plastic material.

17. The article of claim 16, wherein said plastic material is poly propylene.

* * * * *